United States Patent [19]

Brown et al.

[11] 4,437,249

[45] Mar. 20, 1984

[54] CONVERSION OF MODERN SHOTGUNS INTO MUZZLELOADING SHOTGUNS

[76] Inventors: James R. Brown, 9181 Tarbutton Rd., South Vienna, Ohio 45369; Karlis A. Sirons, 2482 Fox Hollow Rd., Springfield, Ohio 45502

[21] Appl. No.: 359,272

[22] Filed: Mar. 18, 1982

[51] Int. Cl.[3] ..... F41C 21/10

[52] U.S. Cl. ..... 42/51; 42/77

[58] Field of Search ..... 42/51, 77

[56] References Cited

U.S. PATENT DOCUMENTS

| | | | |
|---|---|---|---|
| 158,221 | 12/1874 | Smith | 42/51 |
| 173,476 | 2/1876 | Ladd | 42/51 |
| 4,222,191 | 9/1980 | Lee et al. | 42/51 |
| 4,227,330 | 10/1980 | Chapin | 42/51 |
| 4,232,468 | 11/1980 | Chapin | 42/51 |

*Primary Examiner*—Charles T. Jordan

[57] ABSTRACT

A steel plug is inserted into a modern shotgun to convert it into a muzzleloading firearm. The plug is made for use as a breech plug in a single barrel shotgun without modifications to gun. The plug enables the shotgun to be used as a muzzle-loader with black powder and allows conversion of the gun back to its original condition by simply removing the breech plug.

1 Claim, 3 Drawing Figures

CONVERSION OF MODERN SHOTGUNS INTO MUZZLELOADING SHOTGUNS

BACKGROUND OF THE INVENTION

The shotgun converter is a plug that is designed to convert modern shotguns into muzzle loading firearms. The conversion can be done with ease and requires only a few minutes of time. The conversion allows the use of black powder in the converted shotgun and enables hunters to hunt throughout all hunting seasons in all states. The converter has only one removable part, is easily cleaned, safe to use, and easy to apply to modern shotguns.

DESCRIPTION OF THE PREFERRED EMBODIMENT

Figure 1:
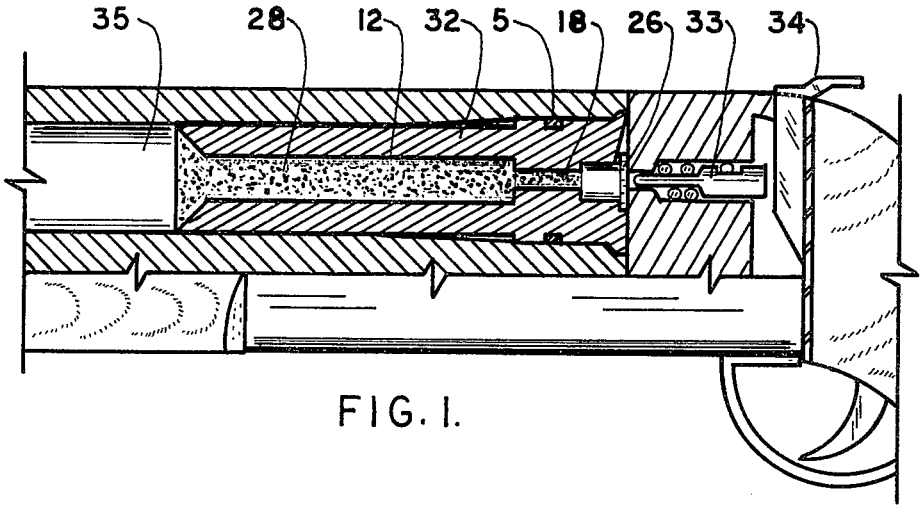
FIG. 1 is a longitudinal cross-sectional view of the converter inserted in a modern shotgun.
Figure 2:
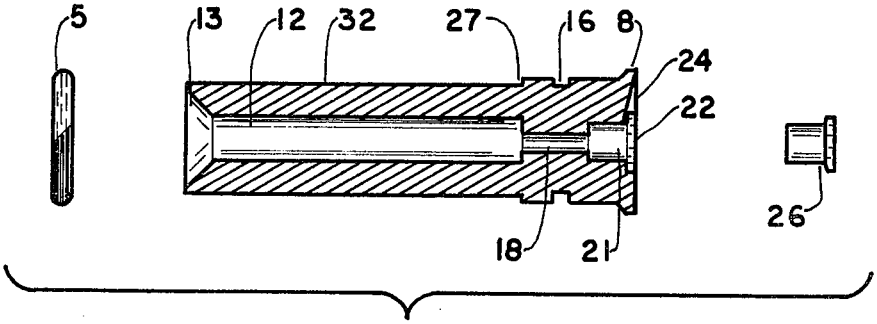
FIG. 2 is an exploded view of the converter with the plug shown in longitudinal cross-section.
Figure 3:
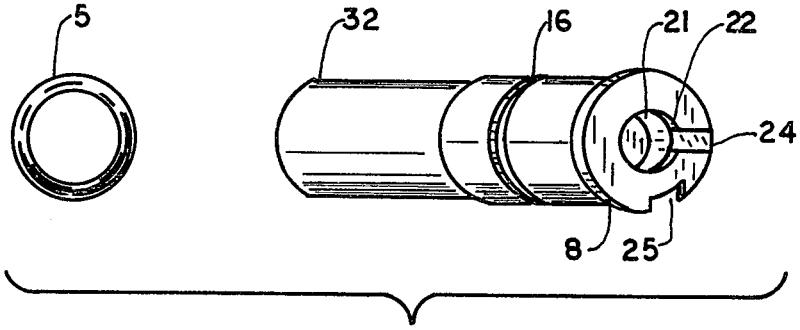
FIG. 3 is a perspective view of the converter.

Referring to the drawings, the converter 32 is inserted in the chamber of shotgun barrel 35 to convert the shotgun into a muzzleloading firearm. The converter 32 has a large diameter rear portion conforming to the shape of the shotgun chamber and a reduced diameter portion extending forwardly from a shoulder 27 with the rear portion into the barrel bore. The converter 32 has a main bore 12 in the reduced diameter portion of receiving black powder 28 when the firearm is loaded as a muzzleloader and the forward end of the bore 12 is flared outwardly. The rear portion of the converter 32 has a tapered primer receiving bore 21 for receiving primer 26 and a counterbore 22 for the primer rim. The converter 32 has a small bore 18 between the primer bore 21 and main bore 12 to allow the flash from primer 26, when struck by the hammer 34 and firing pin 33, to communicate with the powder 28 in main bore 12 to ignite the muzzleloaded charge. The rear portion of the converter has an annular groove 16 for receiving an O-ring 5 as a sealing means between the converter 32 and the shotgun chamber. The converter 32 also has a tapered slot 24 to aid in the removal of primer 26 during loading and unloading of the muzzleloader, and a notch 25 in the tapered annular rim or shoulder 8 to allow the shotgun ejector to bypass the plug when the gun is opened.

The converter 32 is made of mild steel and the rear portion conforms to the shape of the firearm chamber and when in place seals the chamber and converts the shotgun into a muzzleloading firearm. To convert the muzzleloader back to its original condition the converter 32 is simply removed.

What is claimed is:

1. A conversion plug for removable insertion into a standard, unmodified shotgun having a conventional chamber and barrel for converting the shotgun into a muzzleloading firearm, said plug comprising: a cylindrical rear portion conforming to the shape of the shotgun chamber and having a tapered rear shoulder for engaging a cartridge rim receiving portion of the chamber; a reduced diameter forward portion extending forwardly from the plug rear portion into close fitting engagement with the bore of the shotgun barrel; said plug forward portion having a main bore with an outward flare at the front end thereof for receiving black powder when the firearm is loaded as a muzzleloader; said plug rear portion having a tapered bore therein for receiving a primer and a passageway connecting said primer bore with the main bore in said plug forward portion; said tapered rear shoulder of said plug rear portion having a circumferential cut-out therein allowing an ejector mechanism of said shotgun to bypass said plug, thereby avoiding ejection of said plug by the ejector mechanism; said plug rear portion having a circumferentially oriented groove therein and an annular sealing means in said groove; and said plug rear portion having a tapered slot in the rear end thereof intersecting said primer bore for aiding in the removal of a primer positioned in said primer bore.

* * * * *